US006192782B1

(12) United States Patent
Rogers

(10) Patent No.: US 6,192,782 B1
(45) Date of Patent: Feb. 27, 2001

(54) TORQUE CONTROL MEANS FOR HYDRAULIC MOTOR

(76) Inventor: John W. Rogers, 3634 Philwood, Memphis, TN (US) 38122

( * ) Notice: Subject to any disclaimer, the term of this patent is extended or adjusted under 35 U.S.C. 154(b) by 0 days.

(21) Appl. No.: 09/224,160

(22) Filed: Dec. 31, 1998

(51) Int. Cl.[7] ..... F01C 21/12
(52) U.S. Cl. ..... 91/59; 60/468
(58) Field of Search ..... 91/59, 1; 60/468, 60/328; 92/5 R

(56) References Cited

U.S. PATENT DOCUMENTS 4,552,041 * 11/1985 Coyle, Sr. ..... 81/470
5,433,119 * 7/1995 Rogers ..... 73/862.193

* cited by examiner

*Primary Examiner*—Edward K. Look
*Assistant Examiner*—Thomas E. Lazo
(74) *Attorney, Agent, or Firm*—Browning Bushman

(57) ABSTRACT

A fluid pressure control system for limiting the torque output of a positive displacement hydraulic motor (21) for rotating a screw anchor (11, 11') into the ground. A normally closed solenoid operated control valve (76) is mounted in a bypass line (86) between the high pressure supply line (30) and the low pressure exhaust line (36). A plurality of electro-hydraulic switches (72) are arranged for setting at different predetermined fluid pressures and are in fluid communication with a differential pressure sensing chamber (63). Upon turning on of a selected switch (72) having the desired pressure level, the reaching of the desired pressure level activates the selected switch (72) for actuation of solenoid operated control valve (76) to move control valve (76) to an open position as shown in FIG. 3 to bypass fluid from high pressure line (30) to exhaust line (36) to limit the torque output of the motor (21).

6 Claims, 2 Drawing Sheets

TORQUE CONTROL MEANS FOR HYDRAULIC MOTOR

FIELD OF THE INVENTION

This invention relates to torque control means to control or limit the torque exerted by a positive displacement hydraulic motor, more particularly a positive displacement hydraulic motor that operates to rotate a tool or anchor into the ground.

BACKGROUND OF THE INVENTION

Heretofore, as shown particularly in U.S. Pat. No. 5,433,119 dated Jul. 18, 1995, a positive displacement hydraulic motor is utilized to screw a pile in the ground. It is desirable to have an indication of the torque applied to the screw pile or anchor as the level of torque required to turn the new pile is indicative of the strength of the soil and may be used to estimate the capacity of the soil. Low installation torque indicates a weak soil and low pile capacity, whereas a high installation torque indicates a relatively strong soil and greater pile capacity. Where the required installation torque can be accurately measured, the approximate holding capacity of a new pile can be reliably predicted.

A torque indicator system is illustrated in U.S. Pat. No. 5,433,119 for measuring the torque output of a positive displacement hydraulic motor that operates to screw a foundation pile into the ground. The pressure drop across the hydraulic motor is indicated on the gauge for a visual display of the torque output. However, there is no control over the amount of torque provided by the motor. It is desired to protect the motor from an unusually high output torque and also to limit the torque applied by the motor against the screw for rotating the anchor pile as damage could result. Thus, it is desired that the torque output of the hydraulic motor be controlled and limited to a predetermined amount.

It is an object of the present invention to provide a fluid pressure control system to limit the output torque of a positive placement hydraulic motor to a selected amount for rotating a member in the ground.

SUMMARY OF THE INVENTION

The present invention is directed particularly to a fluid pressure control system for limiting the output torque of a positive displacement hydraulic motor for rotating a member, such as a screw anchor, in the ground. The hydraulic motor has an inlet for the supply of high pressure fluid and an outlet for the exhaust of low pressure fluid. A differential pressure gauge is provided for a differential fluid pressure sensing means in fluid communication with the motor through a high pressure line and a low pressure line. The gauge measures the pressure drop or torque output of the motor.

A plurality of electro-hydraulic pressure switches are in fluid communication with the differential pressure line to the gauge and each switch is set at a predetermined differential pressure at which it is desired to limit the output torque for the hydraulic motor.

A hydraulic pump supplies fluid from a reservoir through a supply line to the motor and fluid is returned from the motor to the reservoir through a return line to the fluid supply. A bypass line connects the supply line and the return line and a normally closed solenoid actuated control valve is positioned in the bypass line and is responsive to a selected pressure switch for actuation at a predetermined fluid pressure differential at which the selected valve is set. Each of the pressure switches is set for a different predetermined pressure differential and a switch selected for the predetermined pressure differential is turned on. Upon the predetermined pressure differential being reached at which the switch is set, the solenoid operated control valve is actuated to permit fluid to bypass the motor thereby limiting the torque output to the motor. It is apparent that any desired number of switches may be provided for setting at various predetermined differential pressures equivalent to the pressure drop across hydraulic motor. As a result, the torque output of the hydraulic motor is limited and does not reach an undesirable high level so that injury or damage results to the motor or to the screw anchor being screwed or rotated into the ground.

Other features, and advantages of the invention will be more apparent from the following specification and drawings.

DESCRIPTION OF THE INVENTION

Figure 1:
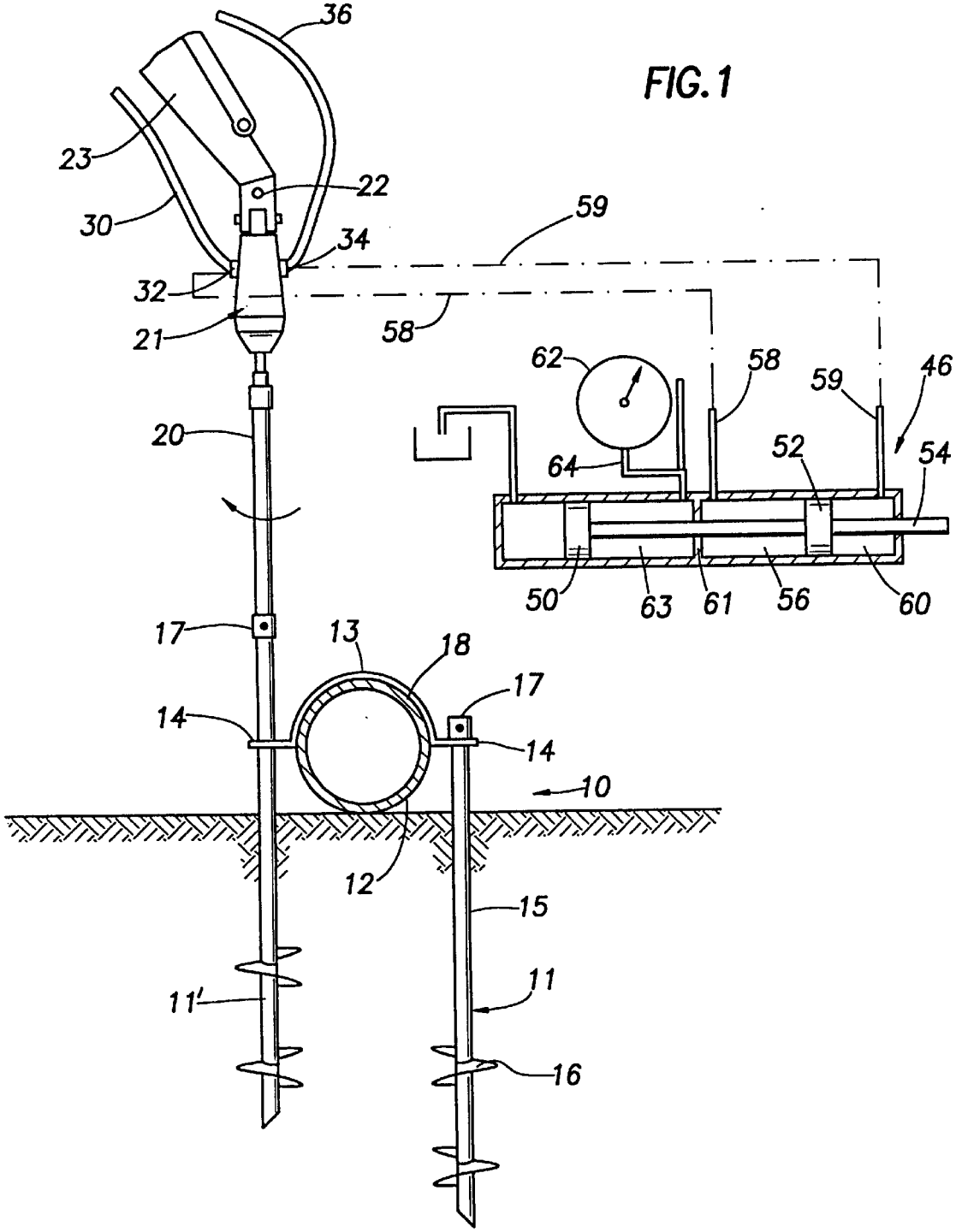
FIG. 1 is an elevational view of a typical screw anchor for a pipeline being installed with the present invention for sensing and limiting the torque applied to the screw anchor and motor.

Referring now particularly to the drawings for a better understanding of this invention and more particularly to FIG. 1, a typical pipeline screw anchor assembly is shown generally at 10. The assembly 10 indudes a pair of screw anchors 11, 11' which are driven on opposite sides of a pipeline 12, and a semicircular bracket 13 having outwardly extending flanges 14 with holes which slidably receive the upper portions of the screw anchors 11, 11'. Each anchor includes an elongate steel bar or shaft 15 which can have a range of diameters suitable for a particular application. However, for pipeline applications, the most common shaft sizes are 1¼" round or 1½" square bar having an overall length of about 10 feet. In some applications, larger shaft diameters in the range of 3–10 inches can be used, depending upon design loads and requirements. One or more steel helixes 16 are welded to each shaft 15 as shown, and function to screw the shafts down into the ground in response to torque applied to the upper ends thereof. When screwed fully down, an enlarged diameter coupling 17 on the top of each of the shafts 15 engages a flange 14 which extends outward of the bracket 13 to hold the pipeline 12 down against the ground. A protective pad 18 usually is positioned between the inner side of the bracket 13 and the adjacent outer surface of the pipeline 12.

As shown in FIG. 1, the anchor 11 has already been screwed down, and the anchor 11' is in the process of being screwed down. The stop collar 17 at the upper end of the anchor 11' is attached to a drive shaft 20 that is connected to the output of a positive displacement hydraulic motor (M) 21. The motor 21 is nonrotatably suspended by a block 22 on the outer end of the boom 23 of a typical crane (not shown) so that the motor can be positioned out over the respective screw piles as they are driven. When the anchor has been rotated down until the stop collar 17 engages a flange 14, the drive shaft 20 is disconnected so that the motor 21 and the crane can be moved to another location along the pipeline 12 where another anchored bracket assembly is to be set.

The level of torque that is required to screw an anchor pile 11 into the ground should be carefully monitored. As noted above, the torque level is indicative of the strength of soil, and can be used to predict the capacity of the anchor. Low installation torque indicates a weak soil, and high torque indicates a strong soil with greater pile or anchor capacity. When the required installation torque is known, the approximate minimum holding capacity of a screw anchor can be reliably predicted. However, an unusually high installation torque may be obtained when the screw anchor strikes an obstuction which may result in damage to the hydraulic motor 21 and/or the respective screw anchor 11 or 11' being screwed into the ground.

Figure 2:
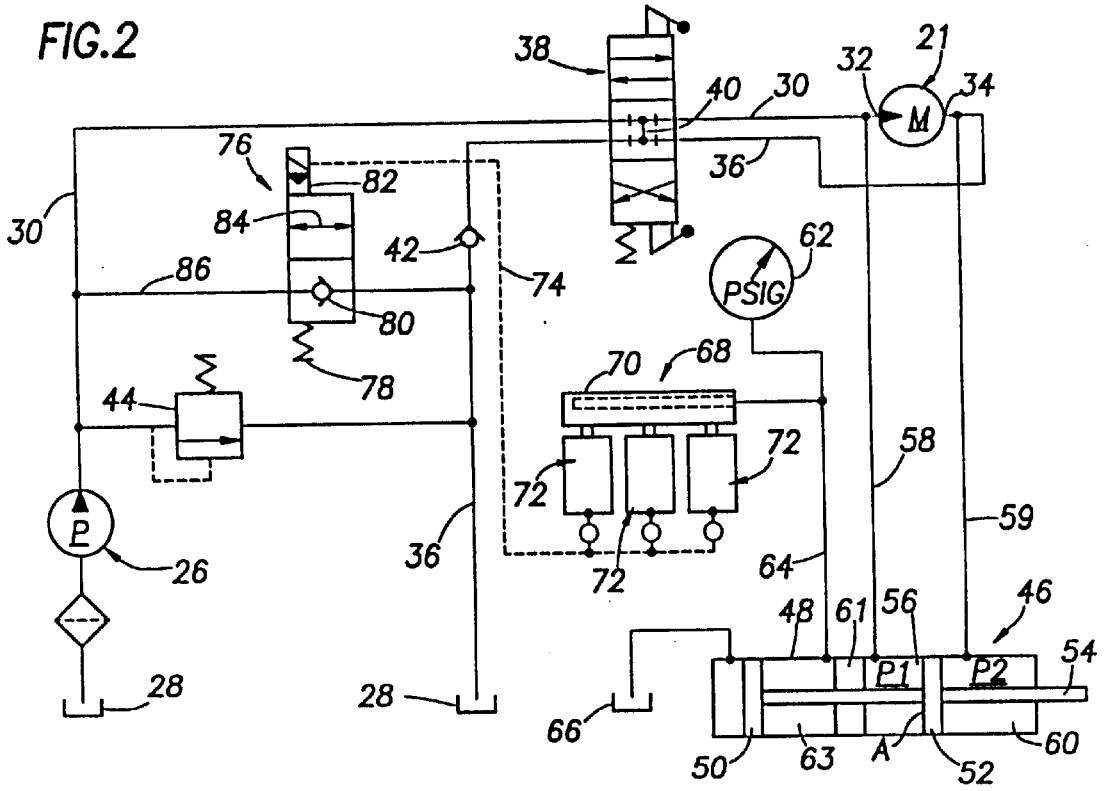
FIG. 2 is a schematic view of the control system showing the system in a non-operating position.
Figure 3:
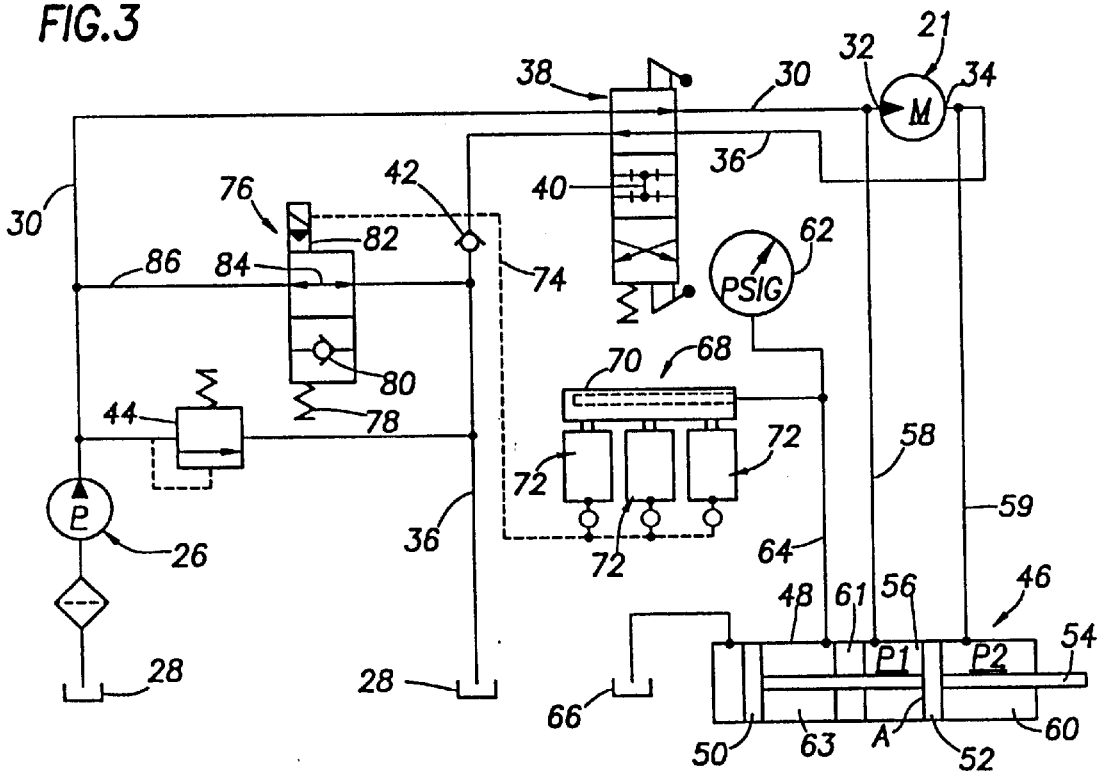
FIG. 3 is a schematic view similar to FIG. 2 but showing the control system in an operating position with the torque output of the motor being limited by the control system from the pressurized hydraulic fluid bypassing the hydraulic motor.

A hydraulic fluid control system is illustrated schematically in FIGS. 2 and 3 for measuring the torque output of fluid motor 21 and for limiting the torque output to a selected amount. A fluid pump (P) 26 supplies hydraulic fluid from a reservoir 28 through a high pressure fluid line 30 to inlet 32 of hydraulic motor 21. Hydraulic fluid from motor 21 exits outlet 34 and is returned by low pressure return line 36 to reservoir 28. A four-way three position open center control valve 38 is provided across high pressure inlet line 30 and low pressure return line 36 to control the flow of hydraulic fluid to motor 21. Control valve 38 includes a bypass line 40 in the inoperative position of control valve 38 shown in FIG. 2 so that operation of pump 26 without actuation of control valve 38 results in the bypassing of fluid from high pressure inlet line 30 to low pressure outlet line 36 without operation of motor 21. A check valve 42 is provided in line 36 to prevent a back flow of fluid. A safety relief valve 44 is also mounted between lines 30 and 36.

For measuring the torque output of motor 21, a torque sensing device is shown generally at 46 and includes a fluid cylinder 48 in which a pair of pistons 50, 52 are secured to piston rod 54 on opposed sides of an intermediate cylinder wall 61. A high pressure fluid chamber 56 is provided between wall 61 and piston 52 and communicates through line 58 with inlet 32 of motor 21. A low pressure fluid chamber 60 adjacent piston 52 is in fluid communication with outlet 34 of motor 21 through line 59. An annular fluid chamber 63 between piston 50 and wall 61 provides a sensing chamber for sensing the pressure differential between chambers 56 and 60. The area A of the face of piston 52 is exposed to high pressure fluid in chamber 56. A vent to atmosphere for cylinder 48 is shown at 66.

A pressure gauge 62 is connected by line 64 to fluid chamber 63. Gauge 62 senses the pressure of the hydraulic fluid in annular chamber 63 between the inner face of piston 50 and the common wall 61. Chambers 56, 60 and 63 are filled with hydraulic fluid. The net or resultant forces, in pounds, which creates a reading on pressure gauge 62 is equal to (P1–P2) A where A is the area of the exposed face of piston 52 in square inches. The pressure reading of gauge 55 is the net force 20 divided by the area A, or (P1–P2) which is the pressure drop across hydraulic motor 21. The gauge readout relates directly to motor torque. For further details of the torque sensing device 46, reference is made to U.S. Pat. No. 5,433,119, the entire disclosure of which is incorporated by this reference for all purposes.

For limiting the torque output of motor 21 to a predetermined valve or level, an electro-hydraulic pressure switch assembly is shown generally at 57 and includes a manifold 70 in fluid communication with line 64 to gauge 62. Thus, pressure switch assembly 68 is in fluid communication with the torque output of motor 21. A plurality of electro-hydraulic pressure pressure switches 72 are mounted on manifold 10 and each pressure switch 72 is set manually for actuation at a predetermined fluid pressure. Each pressure switch 72 is set for a different fluid pressure and only one pressure switch 72 which has the desired pressure level is turned on and is operable. A manual dial which may be set by a hand tool is utilized for setting of pressure switches 72. An electro-hydraulic pressure switch which is satisfactory is manufactured by Commercial Shearing, Inc. under no. OE4-SBHS-6K and may be purchased from Hydraquip Corporation, Houston, Tex.

Pressure switches 72 are connected by an electrical line or conduit 74 to a solenoid operated control valve generally indicated at 76. Solenoid operated control valve 76 is normally closed and is urged by spring 78 to the normally closed position as shown in FIG. 2. A check valve 80 in a normally closed position prevents fluid flow between lines 30 and 36. Solenoid 82 is energized by an electrical output signal from a selected pressure switch 72 when the differential pressure or torque output reaches the fluid pressure at which the selected switch 72 is set. Upon energizing of solenoid 82, control valve 76 moves to the open position shown in FIG. 3 with fluid passage 84 of control valve 76 communicating line 30 with line 36. In this position, fluid from pump 26 flows through bypass line 86 and fluid passage 84 to line 36 to reservoir 28 for bypassing motor 21. Thus, the torque output of motor 21 is limited to the fluid pressure differential at which the selected electrohydraulic switch 72 is set.

It is apparent that any number of fluid pressure switches 72 could be provided as desired and set at various predetermined fluid pressures. The combining of the fluid sensing device 46 with torque limiting means including the electro-hydraulic switch assembly 10 and solenoid operated control valve 76 provides a highly effective torque limiting means for motor 21 with pressure switches 72 responsive immediately to the torque output of motor 21. While hydraulic motor 21 has been illustrated as screwing a pile anchor into the ground, it is apparent that motor 21 could be utilized for operation of an auger or earth drilling operation.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A fluid pressure control system for limiting the output torque of a positive displacement hydraulic motor for rotating a screw anchor in the ground; the hydraulic motor having a pressurized supply line for the supply of high pressure fluid to the motor and a return line for the exhaust of low pressure fluid from the motor; said fluid pressure control system comprising:

hydraulic fluid sensing means having a high pressure fluid chamber and a low pressure fluid chamber;

a high pressure fluid line extending from the high pressure chamber to the inlet of said hydraulic motor and a low pressure fluid line extending from the low pressure chamber to the outlet of said hydraulic motor;

a fluid sensing chamber for said hydraulic fluid sensing means for sensing the pressure differential between said high pressure fluid chamber and said low pressure fluid chamber;

a pressure gauge in fluid communication with said fluid sensing chamber to display the differential pressure between the low pressure chamber and the high pressure chamber;

a plurality of pressure actuated switches in fluid communication with said fluid sensing chamber each switch arranged to be set for actuation at a predetermined pressure;

a bypass line between said pressurized supply line and said return line; and a normally closed control valve in said bypass line; said control valve responsive to said pressure actuated switches and actuated at the predetermined differential pressure setting of a selected pressure actuated switch for opening of said control valve to permit fluid flow through said bypass line between said supply line and said return line thereby to limit the fluid pressure in said high pressure line and the output torque of said motor to the predetermined setting of a selected pressure switch.

2. The fluid pressure control system as set forth in claim 1 including:

a fluid sensing line extending from said gauge to said fluid sensing chamber; and a manifold in fluid communication with said fluid sensing line; said pressure actuated switches mounted on said manifold and in fluid communication with said manifold.

3. The fluid pressure control system as set forth in claim 1 wherein said normally closed control valve is a solenoid operated control valve and said pressure actuated switches are electro-hydraulic switches, said switches when actuated sending an output signal to said solenoid operated control valve for actuation of said control valve.

4. The fluid pressure control system as set forth in claim 1 wherein said hydraulic fluid sensing means comprises a hydraulic cylinder having an intermediate wall therein; and a pair of pistons connected by a piston rod mounted on opposed sides of said wall to define three hydraulic fluid chambers;

said low pressure hydraulic fluid chamber defined between one piston and an adjacent end of the cylinder in fluid communication with said return line, said high pressure hydraulic fluid chamber being defined between said one piston and said intermediate cylinder wall in fluid communication with said pressurized supply line, and said hydraulic fluid sensing chamber being defined between said intermediate cylinder wall and the other piston to sense the pressure differential between said low pressure chamber and said high pressure chamber.

5. A method for limiting the output torque of a positive displacement hydraulic motor for rotating a member in the ground; said method comprising:

providing a high pressure hydraulic fluid supply line to the motor and a low pressure hydraulic fluid exhaust line from the motor with a bypass line extending between said supply line and said exhaust line;

providing hydraulic fluid sensing means in fluid communication with said high pressure fluid supply line and said low pressure hydraulic fluid exhaust line for sensing the pressure differential between said supply line and said exhaust line;

providing a gauge in fluid communication with said hydraulic fluid sensing means to provide a readout of said pressure differential;

providing a normally closed control valve in said bypass line;

providing a plurality of pressure actuated switches in fluid communication with said hydraulic fluid sensing means with each switch arranged to be set at a predetermined fluid pressure; and setting one of said switches at the desired predetermined fluid pressure; said control valve being responsive to said one switch at said predetermined fluid pressure and actuated upon said predetermined fluid pressure being reached for opening of said control valve to permit a bypass of fluid between said supply line and said exhaust line thereby to limit the output torque of said motor.

6. The method as set forth in claim 5 wherein the step of providing a normally closed control valve comprises providing a solenoid operated control valve, and the step of providing a plurality of pressure actuated switches comprises providing a plurality of eiectro-hydraulic switches, whereby upon the reaching of said predetermined fluid pressure an output signal is sent to said solenoid operated control valve for actuation of said control valve.

* * * * *